United States Patent [19]

Tateno et al.

[11] 3,959,417

[45] May 25, 1976

[54] CARBURETOR

[75] Inventors: Hidenori Tateno, Nagoya; Takanori Nagai, Toyota; Sadao Kurosaka, Nagoya, all of Japan

[73] Assignees: Toyota Judosha Kogyo Kabushiki Kaisha, Toyota, Japan; Toyota Motor Sales Company, Limited, Nagoya, Japan

[22] Filed: Feb. 25, 1974

[21] Appl. No.: 445,424

[30] Foreign Application Priority Data

July 14, 1973 Japan ..... 48-78911

[52] U.S. Cl. ..... 261/39 B; 261/69 R; 261/72 R; 261/DIG. 67

[51] Int. Cl.[2] ..... F02M 5/08

[58] Field of Search ..... 261/DIG. 67, 72, 39 B, 261/69 R, 72 R

[56] References Cited

UNITED STATES PATENTS

| | | | |
|---|---|---|---|
| 2,352,924 | 7/1944 | Vallier | 261/72 R X |
| 2,482,102 | 9/1949 | Dahle | 261/72 R X |
| 2,661,196 | 12/1953 | Ball | 261/69 R X |
| 3,081,984 | 3/1963 | Wise | 261/69 R X |
| 3,706,444 | 12/1972 | Masaki et al. | 261/69 R X |
| 3,779,530 | 12/1973 | Lawrence | 261/44 R |
| 3,789,812 | 2/1974 | Berry et al. | 261/DIG. 67 X |

FOREIGN PATENTS OR APPLICATIONS

| | | | |
|---|---|---|---|
| 62,004 | 6/1955 | France | 261/69 |

*Primary Examiner*—Tim R. Miles
*Assistant Examiner*—Gregory N. Clements
*Attorney, Agent, or Firm*—Woodhams, Blanchard and Flynn

[57] ABSTRACT

A carburetor for minimizing the variation in the ratio of fuel contained in the fuel-air mixture due to fuel evaporation within the float chamber. The carburetor has an air passage providing communication between the float chamber and the air intake pipe at a location upstream of the throttle valve. A further air passage provides communication between the float chamber and the air intake pipe at a location disposed downstream of the throttle valve, which further air passage contains a throttle therein for controlling the flow therethrough.

6 Claims, 5 Drawing Figures

Fig. 3
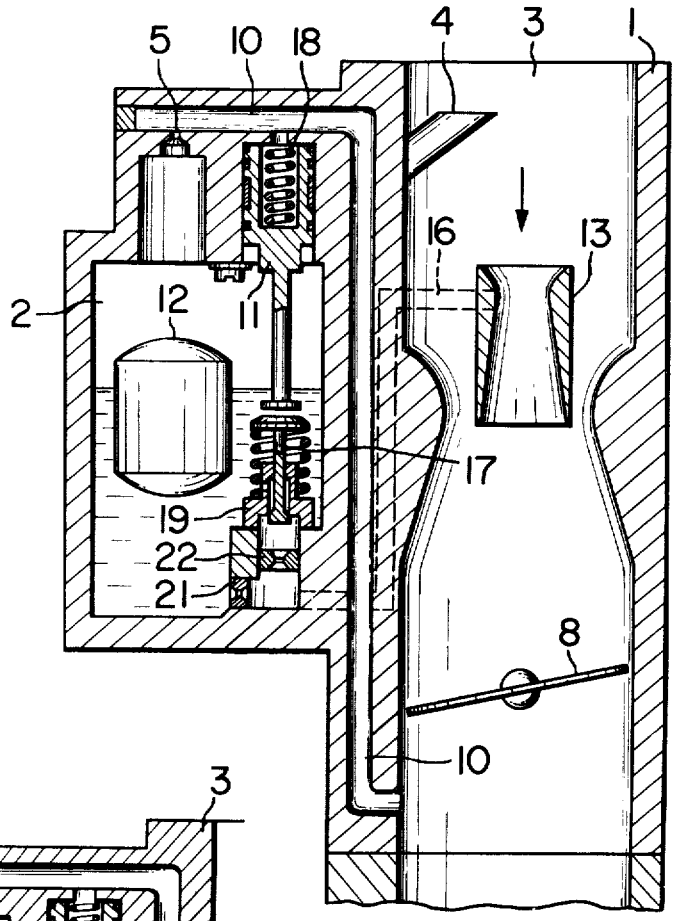
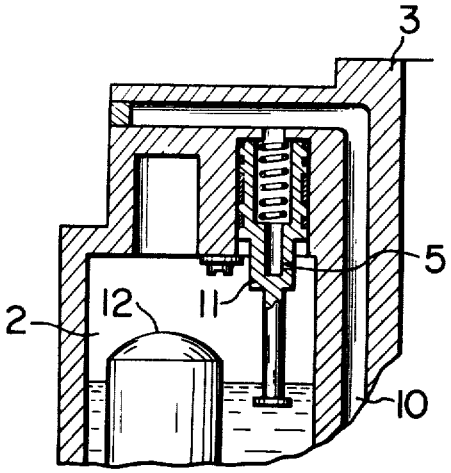
Fig. 4

CARBURETOR

FIELD OF THE INVENTION

The present invention relates to an improved carburetor, such as for an automobile, that prevents the idling state of the engine from becoming unstable when the ratio of fuel contained in the fuel-air mixture is pulsatingly changed by so-called percolation, which is a phenomenon in which part of the fuel in the float chamber evaporates when the temperature of the carburetor rises under the influence of a hot or heated engine.

BACKGROUND OF THE INVENTION

When percolation occurs in conventional carburetors and the pressure of fuel atomized in the float chamber exceeds a certain level, atomized fuel is emitted from the air vent into the air passage, whereby the fuel ratio in the fuel-air mixture supplied to the engine becomes higher. Particularly, when new fuel is fed to the float chamber which is at a high temperature, the new fuel boils suddenly and the atomized fuel produced thereby in the float chamber jets out through the air vent into the air passage, thereby suddenly increasing the ratio of fuel in the fuel-air mixture.

Since, as described above, the fuel ratio of the fuel-air mixture pulsatingly increases or decreases because the atomized fuel jets out into the air passage each time the pressure thereof in the float chamber exceeds a certain level, conventional carburetors thus cause the engine to operate poorly, a condition which is commonly called rough idling.

This invention obviates the above-mentioned disadvantage by providing a carburetor having a further passage which provides continuous communication between the float chamber and the intake pipe. This further passage, which communicates with the intake pipe downstream of the throttle valve, at least when the throttle valve is closed or is only partially open, thus minimizes undesired fluctuations in the fuel-air mixture as supplied to the engine.

BRIEF DESCRIPTION OF THE DRAWINGS

FIG. 3 is a sectional view similar to FIG. 1 but illustrating a further variation wherein the carburetor is for a power jet system.

FIG. 4 is a partial sectional view of a portion of the system illustrated in FIG. 3 and disclosing still a further variation of the present invention.

Figure 1:
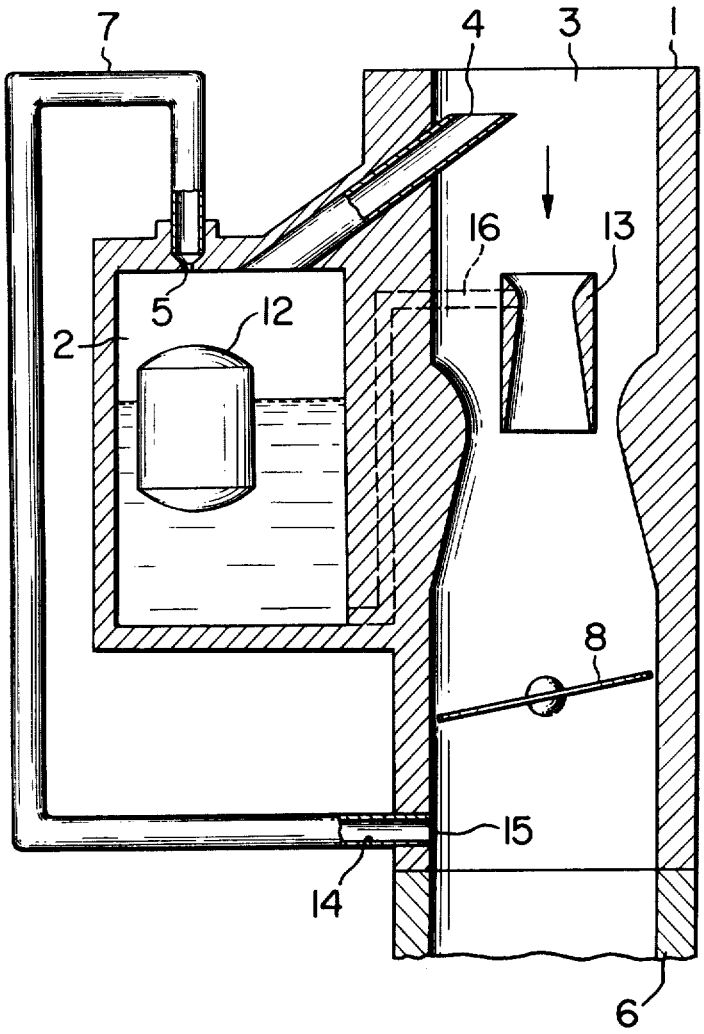
FIG. 1 is a fragmentary cross-sectional view of a portion of the carburetor incorporating therein the present invention.

Certain terminology will be used in the following description for convenience in reference only and will not be limiting. For example, the words "upwardly," "downwardly," "rightwardly" and "leftwardly" will be used to refer to directions in the drawings to which reference is made. The words "inwardly" and "outwardly" will refer to directions toward and away from, respectively, the geometric center of the apparatus and designated parts thereof. Said terminology will include the words above specifically mentioned, derivatives thereof and words of similar import.

SUMMARY OF THE INVENTION

The present invention relates to an improved carburetor for use on vehicles, such as automobiles, which carburetor substantially prevents the idling state of the vehicle engine from becoming unstable due to fluctuations in the fuel-air mixture as caused by percolation. A main air supply passage is provided in a conventional manner between the upper portion of the float chamber and the air intake pipe, which passage communicates with the intake pipe upstream of the throttle valve. To prevent percolation or backflow of evaporated fuel from the float chamber into the air intake pipe, a further passage connects the upper portion of the float chamber and the intake pipe. This further passage communicates with the intake pipe downstream of the throttle valve when same is substantially closed and provides a continuous but restricted communication between the float chamber and the intake pipe for preventing the build up of pressure within the float chamber due to vaporization of fuel.

DETAILED DESCRIPTION

FIG. 1 illustrates a first embodiment of the present invention, wherein there is illustrated a portion of a carburetor 1 having a fuel float chamber 2 associated therewith. The float chamber 2 is supplied with fuel from a conventional fuel supply line (not shown), with the flow of fuel through the supply line into the chamber 2 being controlled by the float 12, which float 12 in turn controls the opening and closing of a conventional inlet supply valve in a conventional manner. The carburetor 1 also includes a conventional inlet air passage 3 which communicates with the intake pipe 6 used for supplying the air-fuel mixture to the combustion engine. The air supply passage 3 has a conventional venturi 13 associated therewith and a fuel supply passage 16 extends from the lower portion of the float chamber 2 to the venturi 13, which fuel supply passage terminates in a discharge orifice located inside the venturi 13 for permitting the fuel to be mixed with the air which flows through the venturi, the flow occuring in a downward direction, as illustrated by the arrow in FIG. 1. The carburetor also includes a conventional movable throttle valve or plate 8 disposed within the passage 3 and located downstream of the venturi 13. An air vent or passage 4 provides communication between the passage 3 and the upper portion of the float chamber 2. The vent 4 communicates with the passage 3 at a location disposed upstream of both the throttle plate 8 and venturi 13, but is located downstream of a conventional movable choke plate (not shown).

The above-described carburetor structure is substantially conventional, and thus further illustration and description of same is not believed necessary. However, with the above-described structure, it has been a long standing problem that vaporized fuel within the float chamber will, in a variable and pulsating manner, flow backwardly through the air vent 4 into the main supply passage 3, thereby causing extreme variations in the air-fuel mixture as supplied to the engine under idling condition, thus resulting in a rough idling engine.

To overcome the above-mentioned problem, the carburetor 1 of the present invention is provided with a pipe 7 defining therein a further flow passage 14. The pipe 7 extends between the chamber 2 and the air passage 3 so as to permit continuous communication therebetween. The passage 14 at one end thereof communicates with the upper portion of the float chamber, whereby the passage communicates with that area of the chamber which contains therein the vaporized fuel. On the other hand, the discharge end 15 of the passage 14 communicates with the air supply passage 3 at a location disposed downstream of both the venturi 13 and the throttle plate 8. The passage 14, where it communicates with the float chamber 2, is provided with a reduced diameter opening 5, hereinafter referred to as the throttle hole, which hole 5 controls the flow of vapors through the passage 14 from the chamber 2 to the passage 3.

Because of the above-described arrangement, air is always induced from the air passage 3 through the air vent 4 into the float chamber 2 while the engine is running. Since such amount of air, which is controlled by the throttle hole 5, is introduced through the communicating passage 14 into the intake pipe 6, the atomized fuel in the float chamber 2 mixes with the air and is also discharged through the communicating passage 14 into the intake pipe 6. Further, since the pressure at the outlet 15 of said communication passage is negative, the air introduced through said air vent 4 into chamber 2 flows uniformly through the passage 14 toward the outlet 15 of said communicating pipe 7, thereby arresting an increase in the pressure of the atomized fuel in the float chamber 2. Also, the fresh air induced into chamber 2 through the air vent 4 restrains the elevation of temperature in the float chamber. All of this prevents said sudden boiling phenomenon which has heretofore been experienced when fuel is supplied to the float chamber 2. As a result, no rough idling occurs because the atomized fuel does not jet out through the passage 4 into the air passage 3. However, even if part of the atomized fuel should flow backwards through the air vent 4 into the air passage 3, the amount of such backflow is substantially minimized so that rough idling is reduced to a marked extent as compared with conventional carburetors.

Figure 1A:
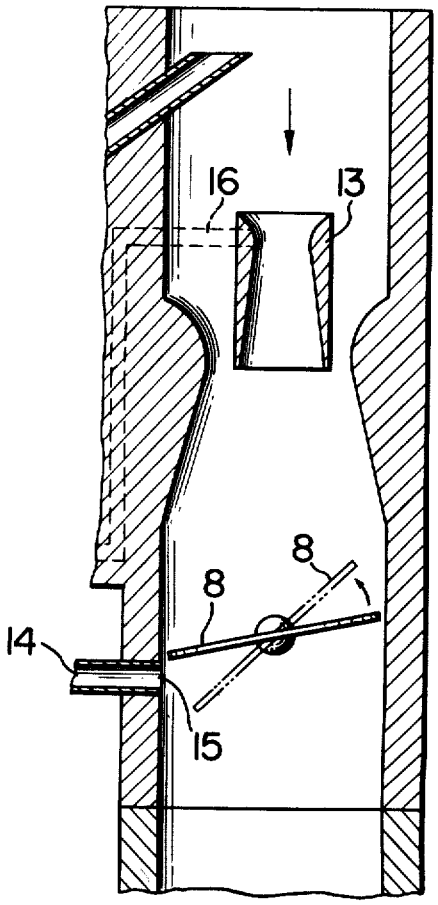
FIG. 1A is a fragmentary cross-sectional view of a portion of FIG. 1 and illustrating a variation thereof.

Furthermore, the discharge opening 15 may be located at a position such that it is disposed downstream of the throttle valve 8 when same is in a substantially closed position, as illustrated by solid lines in FIG. 1A, with the discharge opening 15 being located substantially upstream of the throttle valve 8 when same is in an open position as illustrated by dotted lines in FIG. 1A. Accordingly, the engine operation which results from the positional arrangement of FIG. 1A can be confined primarily to those times when the throttle plate 8 is substantially closed, at which time the pressure at the discharge opening 15 is negative. On the other hand, when the throttle plate is opened, so that the discharge opening 15 is located substantially upstream of the throttle plate, the pressure adjacent the discharge opening 15 is substantially atmospheric so that the passage 14 is effectively rendered inoperative. With the discharge opening 15 positioned as shown in FIG. 1A, the improvement of the present invention is thus beneficial for eliminating those engine phenomenon such as rough idling, surging and the like which occur mainly when the throttle plate is substantially closed.

When the discharge opening 15 associated with the passage 14 is located downstream of the throttle plate as illustrated in FIG. 1A, then the throttle hole 5 associated with the passage 14 is preferably provided at the discharge end of the passage 14, rather than at the inlet end as illustrated in FIG. 1. Providing the throttle hole 5 at the discharge opening 15 is preferred since this facilitates the accurate positioning of the discharge opening relative to the throttle plate.

Figure 2:
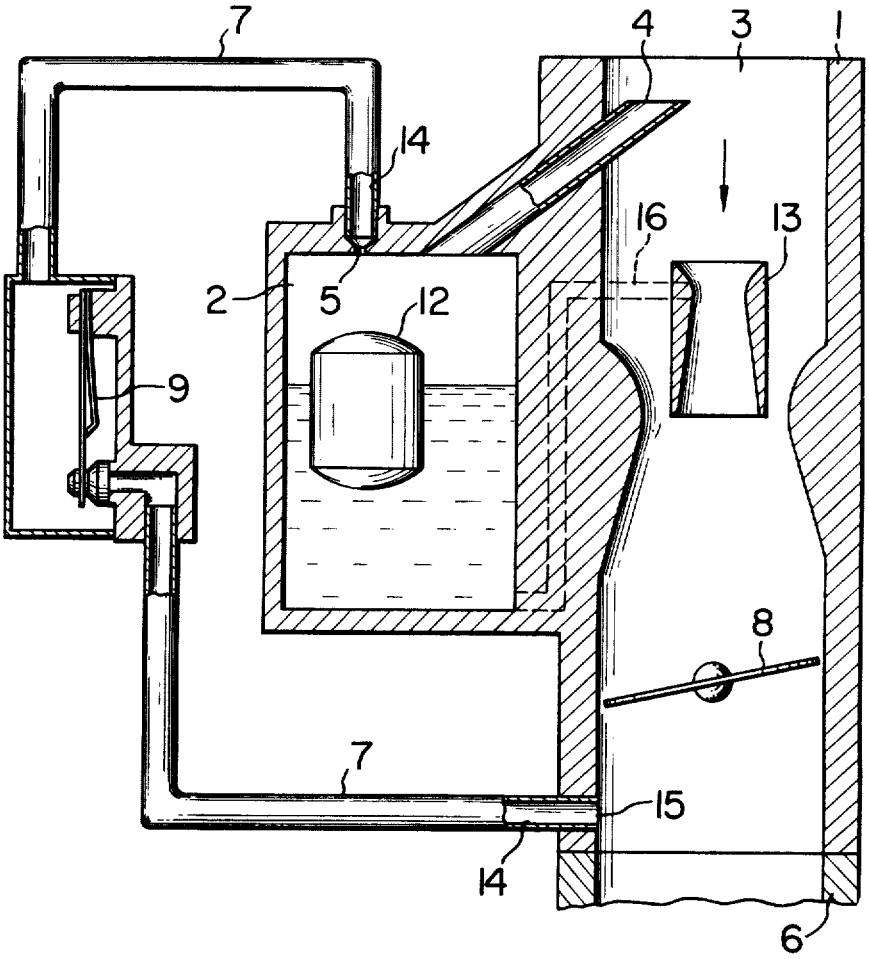
FIG. 2 is a sectional view similar to FIG. 1 but illustrating a variation of the present invention.

FIG. 2 shows a second embodiment of the invention which is identical to the first embodiment of FIG. 1, as described above, except that a switching valve 9 is associated with the flow passage 14 for controlling the flow therethrough. The switching valve 9, which may be a thermo or solenoid valve, is controlled by the engine temperature and opens when the engine temperature rises above a predetermined temperature, the valve being controlled by the temperature between the float chamber 2 and the intake pipe 6. Thus, the valve 9 will open only when a preselected temperature is exceeded, so that flow from chamber 2 through passage 14 to intake pipe 6 will thus occur only under those conditions where the above-described boiling and vaporization is normally experienced. In the embodiment of FIG. 2, the throttle hole 5 may be provided by means of the switching valve 9 if desired. Other than the structural and functional variations described above, the embodiment illustrated in FIG. 2 is in all other respects structurally and functionally the same as the embodiment illustrated in FIG. 1.

FIG. 3 shows a third embodiment of the invention in which a negative pressure passage 10 is used as the communicating pipe in a power jet system carburetor.

To be more precise, the float chamber 2 communicates, through the throttle hole 5, with the intake pipe 6 by the negative pressure passage 10 of the power jet system. By suitably selecting the diameter of said throttle hole 5, there is little need to modify the working stroke of the power piston 11 used in the power jet system. Accordingly, the same operation and result as are obtained with the embodiment of FIG. 1 can be achieved without providing a separate communicating pipe of the kind used therein.

With respect to the operation of the carburetor system illustrated in FIG. 3, under low loads the throttle plate 8 is substantially closed so that only a small amount of air flows past the throttle plate. A substantial vacuum is thus created downstream of the throttle plate which, by being transmitted through the passage 10, causes the power piston 11 to be moved upwardly away from the plunger 17 in opposition to the urging of the spring 18. The upward movement of plunger 17 thus causes the power valve 19 to close, thereby preventing additional fuel from being injected into the air stream of the venturi 13. Under these conditions, the engine is thus driven under the most economical condition since the engine is supplied only with such fuel as is fed through the main fuel supply jet 21. However, when a heavy load is experienced, then the throttle plate 8 is opened and a large amount of air flows therepast, thus resulting in a substantially smaller vacuum being created in the intake manifold located downstream of the throttle plate. A smaller negative pressure is thus applied to the power piston 11 so that the spring 18 thus forces the piston 11 downwardly into engagement with the plunger 17 and depresses same so as to open the power valve 19. Additional fuel then flows through the power jet 22 into the passage 16 for supply to the venturi 13. Under these conditions, additional quantities of fuel are thus injected into the air which flows through the venturi 13, thereby resulting in a more dense air-fuel mixture being discharged from the venturi into the intake manifold.

The operation of the power jet illustrated in FIG. 3, as described above, is substantially conventional except that a common passage 10 which communicates with the air intake passage 3 at a location downstream of the throttle plate can be used for both controlling the power jet system and communicating with the upper region of the float chamber 2.

FIG. 4 illustrates a fourth embodiment of this invention, in which said throttle hole 5 in the above-described third embodiment is provided in the power piston 11 itself, instead of the float chamber 2. As in the case of the embodiment of FIG. 3, there is little need to modify the working stroke of the power piston 11 if the diameter of said throttle hole 5 is suitably selected.

As may be understood from the above, the present invention restrains the elevation of the temperature in the float chamber by communicating said float chamber with the intake pipe and introducing fresh air into the chamber, taking advantage of the negative pressure of said intake pipe. Also, any increase in the pressure of the atomized fuel in the float chamber is arrested or minimized by sucking therefrom the fresh air introduced therein together with said atomized fuel. By this means, the atomized fuel in the float chamber no longer jets out through the air vent into the air passage. Consequently, worsening of the engine's running condition or its unstable idling state can be prevented, which might otherwise occur when the ratio of fuel in the fuel-air mixture pulsatingly changes.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privelege is claimed are defined as follows:

1. In a carburetor having a housing defining a float chamber for receiving fuel thererin and a movable float associated with said chamber for controlling the quantity of fuel in said chamber, an intake pipe adapted to receive air therein and supply an air-fuel mixture to an engine, fuel supply passage means connecting said chamber to said intake pipe at a location upstream of the carburetor throttle valve for supplying fuel to said intake pipe, and a power jet system responsive to engine load for supplying additional fuel to said intake pipe, said power jet system including a negative pressure passage communicating at one end thereof with said intake pipe at a location downstream of the throttle valve, said power jet system also including actuator means associated with the other end of said negative pressure passage and movable in response to the pressure within said passage, the improvement comprising means for removing vaporized fuel from the upper part of said float chamber, said last-mentioned means including a communicating passageway connecting said negative pressure passage to the upper part of said float chamber at a location above the liquid level of the fuel, said communicating passageway having throttle means associated therewith for controlling the rate of flow therethrough, whereby the negative pressure created within said negative pressure passage sucks the vaporized fuel from the upper part of said float chamber and discharges same into said intake pipe at a location downstream of the throttle valve.

2. A carburetor according to claim 1, wherein said actuator means comprises a piston movably supported within a compartment formed in the housing, said compartment being in communication with said chamber and the other end of said negative pressure passage, said piston being movably and slidably disposed within said compartment for isolating said chamber from said negative pressure passage.

3. A carburetor according to claim 2, wherein said communicating passageway has one end thereof in open communication with the upper part of said chamber at a location spaced from said compartment, and the other end of said communicating passageway communicating with said negative pressure passage at a location disposed intermediate the ends thereof.

4. A carburetor according to claim 2, wherein said communicating passageway is formed in said piston and extends therethrough to provide communication between the opposite sides thereof, and said throttle means being provided in said piston.

5. A carboretor according to claim 1, including an air passage providing communication between said intake pipe and the upper portion of said float chamber, said air passage communicating with the communicating passageway only indirectly through the connection provided by the upper portion of the float chamber.

6. In a carburetor having a housing defining a float chamber for receiving fuel therein and a movable float associated with said chamber for controlling the quantity of fuel within said chamber, an intake pipe adapted to receive air therein and supply an air-fuel mixture to an engine, fuel supply passage means connecting said chamber to said intake pipe at a location upstream of the carburetor throttle valve for supplying fuel to said intake pipe, and an air passage providing communication between said intake pipe and the upper portion of said float chamber, the improvement comprising means for removing vaporized fuel from the upper part of said chamber and supplying same to said intake pipe, said last-mentioned means including a communicating passageway connected between the upper part of said float chamber and said intake pipe at a location downstream of the carburetor throttle valve, said communicating passageway having throttle means associated therewith for controlling the rate of flow therethrough, said communicating passageway having the inlet end thereof in direct communication with the upper part of said chamber, and said air passage having the discharge end thereof in direct communication with the upper part of said chamber at a location spaced from the inlet end of said communicating passageway, whereby said communicating passageway and said air passage communicate with one another only through the upper part of said chamber, and temperature-controlled valve means associated with said communicating passageway for permitting flow therethrough only when the engine temperature exceeds a predetermined value.

* * * * *